US012729634B2

(12) United States Patent
Schirmer

(10) Patent No.: US 12,729,634 B2
(45) Date of Patent: Sep. 8, 2026

(54) CYLINDER HEAD COVER, AND METHOD FOR INSTALLING A CYLINDER HEAD COVER

(71) Applicants: thyssenkrupp Dynamic Components GmbH, Ilsenburg (DE); thyssenkrupp AG, Essen (DE)

(72) Inventor: Jens Schirmer, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 0 days.

(21) Appl. No.: 19/107,154

(22) PCT Filed: Aug. 22, 2023

(86) PCT No.: PCT/EP2023/073016
§ 371 (c)(1),
(2) Date: Feb. 27, 2025

(87) PCT Pub. No.: WO2024/046814
PCT Pub. Date: Mar. 7, 2024

(65) Prior Publication Data

US 2026/0071559 A1 Mar. 12, 2026

(30) Foreign Application Priority Data

Aug. 30, 2022 (DE) ..... 10 2022 208 999.5

(51) Int. Cl.
*F01L 1/047* (2006.01)

(52) U.S. Cl.
CPC ..... *F01L 1/047* (2013.01); *F01L 2001/0476* (2013.01)

(58) Field of Classification Search
CPC . F01N 3/2066; F01N 2560/06; F01N 2610/04
See application file for complete search history.

(56) References Cited

U.S. PATENT DOCUMENTS 7,743,749 B1 * 6/2010 Suchecki ..... F02M 39/02 123/495
2011/0126793 A1 * 6/2011 Ahn ..... F01M 1/08 123/196 R

FOREIGN PATENT DOCUMENTS

CN 203 856 525 A1 10/2014
DE 10 2007 014 544 A1 10/2008
(Continued)

OTHER PUBLICATIONS

Machine generated translation of DE102010048267A1 (Year: 2011).*
(Continued)

*Primary Examiner* — Ngoc T Nguyen
(74) *Attorney, Agent, or Firm* — thyssenkrupp North America, LLC

(57) ABSTRACT

In a cylinder head cover with an axial bearing for a camshaft which is received rotatably in the cylinder head cover, the camshaft comprises at least one functional component, wherein the axial bearing comprises at least one pin pair, between which the functional component is arranged. A method for assembling a cylinder head cover comprises inserting the camshaft with the functional component(s) into bearing half shells of a cylinder head cover main body, introducing the pins into receiving openings of the cylinder head cover main body, and placing a bearing frame onto the cylinder head cover main body, wherein the pins dip in portions into receiving openings of the bearing frame.

16 Claims, 6 Drawing Sheets

(56) References Cited

FOREIGN PATENT DOCUMENTS

| | | | | | |
|---|---|---|---|---|---|
| DE | 102007063254 | A1 * | 7/2009 | ..... | F01L 1/46 |
| DE | 10 2010 048 267 | B4 | 5/2011 | | |
| DE | 10 2010 019 130 | A1 | 11/2011 | | |
| DE | 102011012149 | A1 * | 9/2012 | ..... | F01L 1/053 |
| DE | 10 2013 205 129 | A1 | 9/2014 | | |
| DE | 10 2019 107 626 | A1 | 10/2020 | | |
| DE | 10 2019 121 902 | A1 | 2/2021 | | |
| DE | 10 2020 210 257 | A1 | 2/2022 | | |
| DE | 10 2020 210 264 | A1 | 2/2022 | | |
| WO | 2017/079383 | A1 | 5/2017 | | |
| WO | WO-2020193560 | A1 * | 10/2020 | ..... | F01L 1/047 |

OTHER PUBLICATIONS

Machine generated translation of WO2020193560A1 (Year: 2020).*
English Translation of International Search Report issued in PCT/EP2023/073016, dated Nov. 14, 2023.

* cited by examiner

CYLINDER HEAD COVER, AND METHOD FOR INSTALLING A CYLINDER HEAD COVER

CROSS REFERENCE TO RELATED APPLICATIONS

This application is a U.S. National Stage Entry of International Patent Application Serial Number PCT/EP2023/073016, filed Aug. 22, 2023, which claims priority to German Patent Application No. DE 10 2022 208 999.5, filed Aug. 30, 2022, the entire contents of which are incorporated herein by reference.

FIELD

The present disclosure generally relates to a cylinder head cover with an axial bearing for a camshaft which is received rotatably in the cylinder head cover, and to a method for assembling a cylinder head cover.

BACKGROUND

An internal combustion engine with at least one camshaft which has at least one stop element for forming an axial bearing has been disclosed, for example, by DE102007014544. Here, an internal combustion engine is described with at least one camshaft which, in order to form an axial bearing, has at least one stop element which interacts with a bearing frame of the axial bearing for axial mounting, wherein the stop element is formed by a cam of the camshaft, accordingly by a functional component of the camshaft, and the bearing frame has a clearance for the cam shape of the cam. Furthermore, the use of at least one cam of a camshaft of an internal combustion engine as stop element of an axial bearing of the camshaft is described here.

Although a possibility for axial mounting of a camshaft has already been indicated here, there is nevertheless a requirement for improvement, in particular with regard to simpler assembly and/or an axial bearing and/or cylinder head cover which are/is inexpensive to produce.

Thus a need exists for a cylinder head cover as described herein. An inexpensive axial bearing of a functional component of the camshaft and, depending on the connection of the functional component to the remaining camshaft, an inexpensive axial bearing of the camshaft in the cylinder head cover can be proposed by virtue of the fact that the axial bearing comprises at least one pin pair, between which the functional component is arranged. The assembly is also of relatively simple design, since, for example, pins can be handled and assembled easily as standard components. In addition, the required pins can be produced relatively inexpensively as separate components. A further advantage with regard to wear to be expected also lies, furthermore, in the fact that pins enter into linear contact with the functional component, which is substantially more defined than, for example, full surface contact and also brings about advantages with regard to wear.

DETAILED DESCRIPTION

Figure 1:
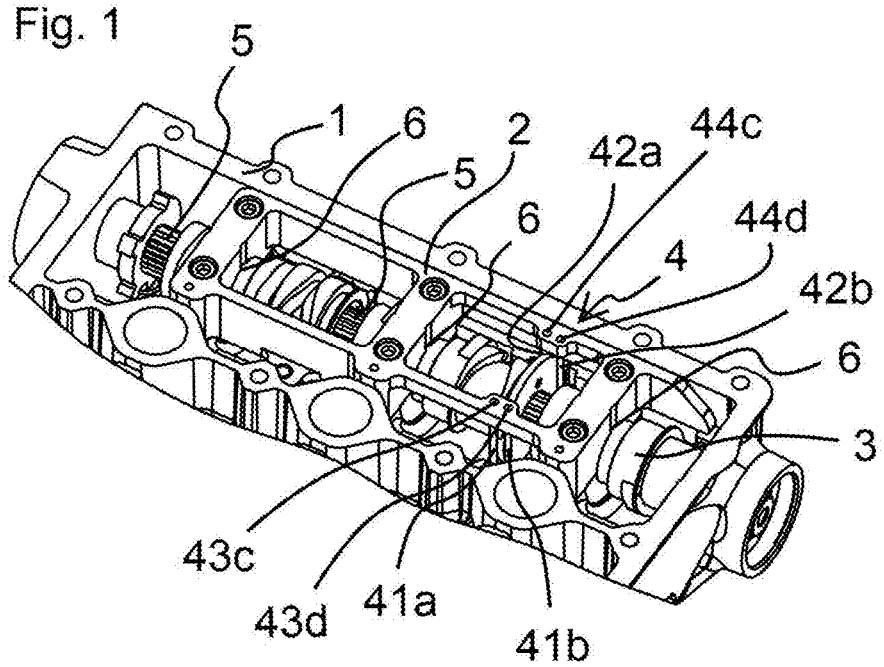
FIG. 1 shows a cylinder head cover according to the invention in a perspective illustration, in particular with a locking disk as functional component which is fixed axially by means of two pin pairs.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

It can be provided in one advantageous refinement of the invention that the axial bearing comprises a further pin pair, between which the functional component is arranged. The pin pairs are preferably arranged on different sides of the camshaft. In a correspondingly homogeneous manner, the functional component can be mounted axially in the pin pairs on both sides.

It can be provided in a further advantageous refinement of the invention that the pin pairs are arranged perpendicularly with respect to the rotational axis of the camshaft. As a result, for example, a bearing frame which is usually placed from above onto a cylinder head cover main body will also be placed correspondingly perpendicularly onto the pin pairs.

It can be provided in a further advantageous refinement of the invention that the pins of the pin pair or the pins of the pin pairs are received in sections in receiving openings. The pins can simply be plugged into receiving openings of this type, which can be, for example, bores.

It can be provided in a further advantageous refinement of the invention that at least one pin of the pin pair, preferably the two pins of the pin pair, is/are received rotatably in the receiving openings. As a result, a further reduction in friction can be achieved, and the wear behavior can be improved, that is to say the wear can be reduced.

It can be provided in a further advantageous refinement of the invention that the cylinder head cover comprises a cylinder head cover main body and a bearing frame, wherein connector openings for the pins are provided both in the cylinder head cover main body and in the bearing frame. A refinement of this type makes assembly advantages possible. The pins can thus, for example, be plugged simply into the connector openings of the cylinder head cover main body, and the bearing cap can subsequently be placed on top, with the result that the pins dip into its connector openings.

It can be provided in a further advantageous refinement of the invention that the cylinder head cover comprises a first cylinder head cover element and a second cylinder head cover element, wherein connector openings for the pins are provided both in the first cylinder head cover element and in the second cylinder head cover element. A refinement of this type makes assembly advantages possible. The pins can thus, for example, be plugged simply into the connector openings of the first cylinder head cover element, and the second cylinder head cover element can subsequently be placed on top, with the result that the pins dip into its connector openings.

It can be provided in a further advantageous refinement of the invention that the functional component is a locking disk, a sensor wheel, a cam, in particular a pump lobe.

It can be provided in a further advantageous refinement of the invention that the camshaft is a sliding camshaft, comprising a basic shaft and at least one sliding cam, wherein the sliding camshaft comprises, in particular, two sliding cams which are connected to one another by means of a coupling rod.

The following designations are used in the figures:

D Rotational axis of the camshaft
1 Cylinder head cover main body
2 Bearing frame
3 Camshaft
4 Axial bearing
5 Sliding spline system
6 Bearing (half) shell, bearing seat or pivot bearing seat
7 Actuator
1*a* First cylinder head cover element
1*b* Second cylinder head cover element
31 Basic shaft
32(*a*) Sliding cam
33 Coupling rod
34 Locking disk (functional component)
35 Sensor wheel (functional component)
321 First cam
322 Second cam
323 Actuating guide
41*a* First pin
41*b* Second pin
42*a* First pin
42*b* Second pin
43*a* Receiving opening
43*b* Receiving opening
43*c* Receiving opening
43*d* Receiving opening
44*a* Receiving opening
44*b* Receiving opening
44*c* Receiving opening
44*d* Receiving opening Here, it goes without saying that features and details which are described in conjunction with a method also apply in conjunction with the apparatus according to the invention and vice versa, with the result that reference is always made or can always be made mutually with regard to the disclosure in respect of the individual aspects of the invention. Moreover, a possibly described method according to the invention can be carried out by way of the apparatus according to the invention.

The terminology used herein serves only for the purpose of describing certain embodiments and is not intended to restrict the disclosure. As used herein, the singular forms "a/an" and "the" are intended to also include the plural forms unless the context clearly indicates otherwise. In addition, it will become clear that the expressions "has" and/or "having", if used in this description, specify the presence of the stated features, integers, steps, operations, elements and/or components, but do not rule out the presence or addition of one or more other features, integers, steps, operations, elements, components and/or groups thereof. As used herein, the expression "and/or" contains any desired and all combinations of one or more of the associated, listed elements.

Reference is made first of all to FIG. 1.

A cylinder head cover according to the invention comprises substantially a cylinder head cover main body 1, a bearing frame 2 and a camshaft 3 which is received rotatably in the cylinder head cover.

The camshaft 3 can be, for example, a sliding camshaft, comprising a basic shaft 31, on which one or more sliding cams 32 are received axially displaceably, but not rotatably with respect to the basic shaft 31. To this end, for example, a sliding spline system can be provided between the basic shaft 31 and the sliding cam 32. Alternative embodiments can also be suitable such as, for example, non-round basic shaft portions, in particular flat positions, and accordingly corresponding openings of the sliding cam 32 for receiving the basic shaft portion. The sliding cam 32 per se comprises an actuating guide 323 and a first cam 321 and at least one second cam 322 with different cam geometries. The sliding cam 32 is displaced axially on the basic shaft 31 by means of an actuator 7, with the result that the first cam 321 or the second cam 322 can be brought into contact with the associated valve train as required.

If, as shown here, two sliding cams 32, 32*a* are connected to one another via a coupling rod 33, a locking disk 34 is preferably used which ensures that a displacement of the sliding cams 32, 32*a* or the coupling rod 33 is possible only at predefined angular positions of the camshaft 3. The locking disk 34 is a functional component of the camshaft 3. Further conceivable functional components are, for example, a sensor wheel, a cam, in particular a pump lobe, etc. An axial bearing 4 is provided for corresponding axial guidance or fixing of the functional component, in particular the locking disk 34, relative to the cylinder head cover or on the cylinder head cover. It is provided according to the invention that the axial bearing 4 is formed by at least one pin pair 41*a*, 41*b*, wherein the functional component 34 is arranged in the axial direction between the pins 41*a*, 41*b* of the pin pair.

In the case of one embodiment, if the functional component 34 is arranged axially displaceably on the camshaft 3, it is guided relative to the cylinder head cover or is held in the axial position by the axial bearing 4, and can discharge axially acting switching forces from the thrust rod into the cylinder head cover or can support them on the latter. If the functional component 34 is arranged axially fixedly on the camshaft 3, the axial bearing of the camshaft 3 can also be realized additionally for discharging/supporting the switching forces. Or, in other words, depending on whether the functional component 34 is received axially fixedly or axially displaceably on the camshaft, the axial bearing 4 brings about axial mounting of the camshaft or merely of the functional component 34.

Figure 2:
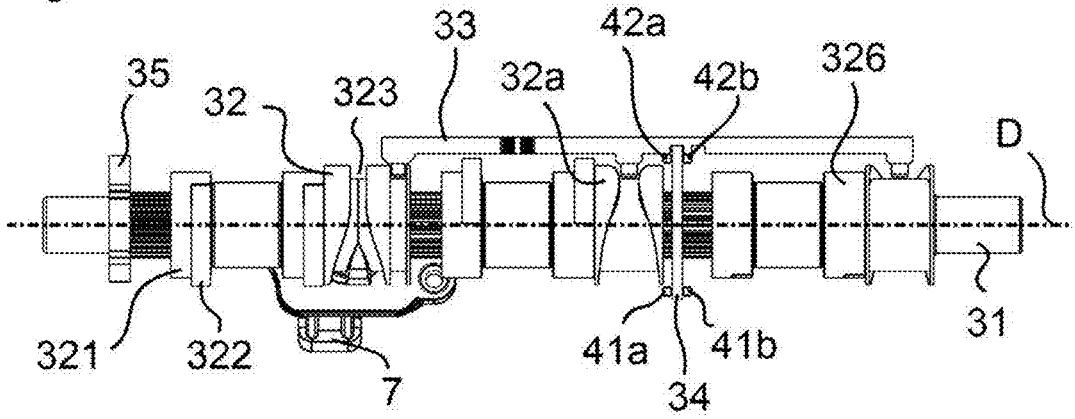
FIG. 2 shows a camshaft of a cylinder head cover according to the invention in a plan view, with a locking disk which is fixed in the axial direction by an axial bearing which consists of two pin pairs.
Figure 3:
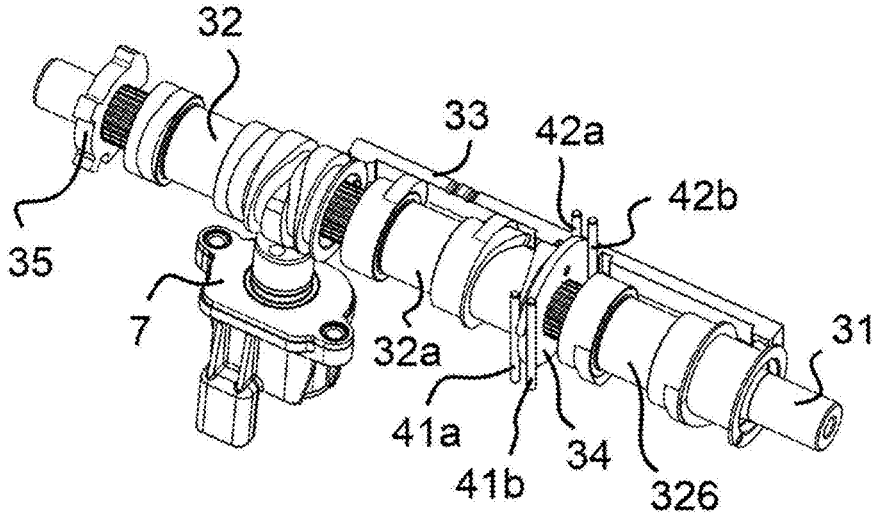
FIG. 3 shows a camshaft of a cylinder head cover according to the invention in a perspective view, with a locking disk which is fixed in the axial direction by an axial bearing which consists of two pin pairs.

It can be seen, in particular, in FIGS. 1 to 3 that each pin pair comprises a first pin 41*a* and a second pin 41*b*. It can be seen that the first pin 41*a* is arranged in the axial direction in front of the functional component 34, in particular the locking disk, and one pin 41*b* is arranged behind the functional component 34.

It can be seen, furthermore, that the axial bearing comprises a further pin pair 42*a*, 42*b*, between which the functional component 34 is arranged. This further pin pair also comprises a first pin 42*a* and a second pin 42*b*. It can be seen that the first pin 42*a* is arranged in the axial direction in front of the functional component 34, in particular the locking disk, and the second pin 42*b* is arranged behind the functional component 34. The pin pairs 41*a*, 41*b* and 42*a*, 42*b* are arranged on different sides of the camshaft 3, however. It can be seen, furthermore, that the pin pairs 41*a*, 41*b* and 42*a*, 42*b* are arranged perpendicularly with respect to the rotational axis D of the camshaft 3.

It is preferably provided, furthermore, that the pins of the pin pair or the pins of the pin pairs 41*a*, 41*b* and/or 42*a*, 42*b* are received in sections in receiving openings 43*a*, 43*b*, 43*c*, 43*d* and/or 44*a*, 44*b*, 44*c*, 44*d*.

It is provided in the embodiment of the cylinder head cover which is shown here that the cylinder head cover comprises a cylinder head cover main body 1 and a bearing frame 2. The cylinder head cover main body 1 and the bearing frame 2 together substantially form the pivot bearings or pivot bearing seats 6 for the camshaft 3. The bearing frame 2 can correspondingly be connected to the cylinder head cover main body 1, for example by means of the screws which can be seen.

It can advantageously be provided that the pins of the pin pair or the pins of the pin pairs 41*a*, 41*b* and/or 42*a*, 42*b* are arranged between the cylinder head main body 1 and the bearing frame 2. To this end, the receiving openings 43*a*, 43*b*, 43*c*, 43*d* and/or 44*a*, 44*b*, 44*c*, 44*d* can be provided for the pins 41*a*, 41*b* and/or 42*a*, 42*b* of the pin pairs both in the cylinder head cover main body 1 and in the bearing frame 2.

Figure 4:
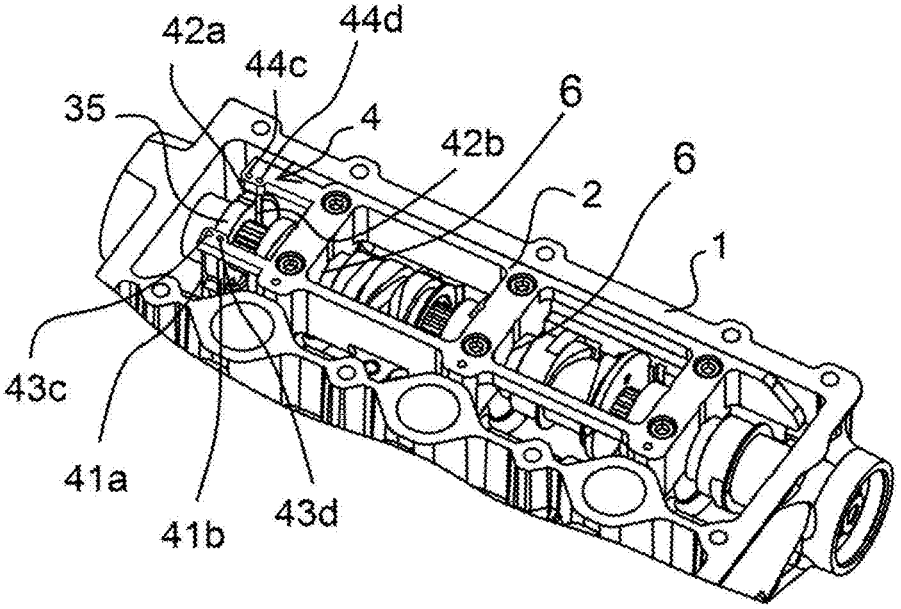
FIG. 4 shows a cylinder head cover according to the invention in a perspective illustration, in particular with a sensor wheel as functional component which is fixed axially by means of two pin pairs.
Figure 5:
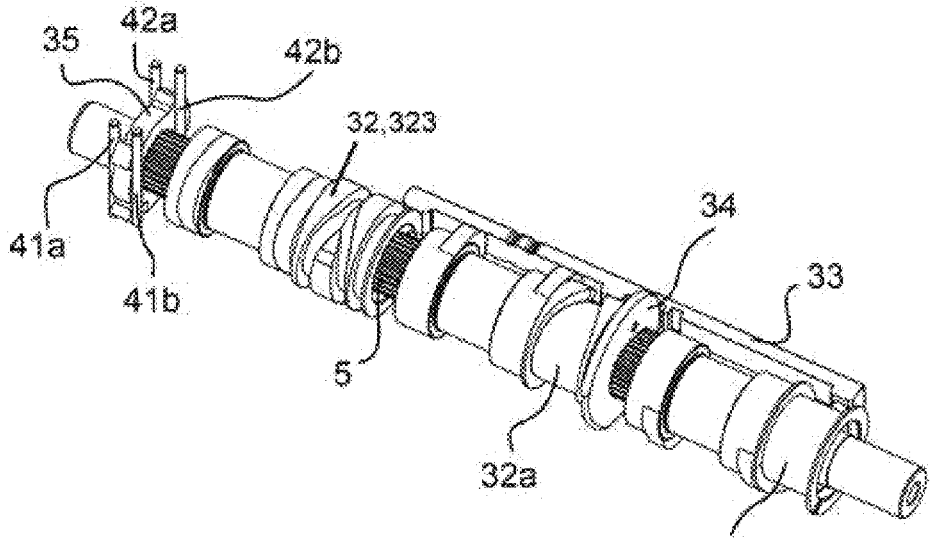
FIG. 5 shows a camshaft of a cylinder head cover according to the invention in a perspective view, with a sensor wheel which is fixed in the axial direction by an axial bearing which consists of two pin pairs.

A further embodiment of the cylinder head cover according to the invention is shown in FIGS. 4 and 5. Here, however, a sensor wheel 35 is provided as functional component which is fixed in the axial direction by the axial bearing 4 according to the invention.

The sensor wheel 35 is fixed on the shaft 3; as a result, the axial bearing of the camshaft 3 can be realized by this component (transmission of force to the cylinder head cover).

With regard to the further details, reference can be made to the axial bearing of the locking disk 34 already outlined above.

Figure 6:
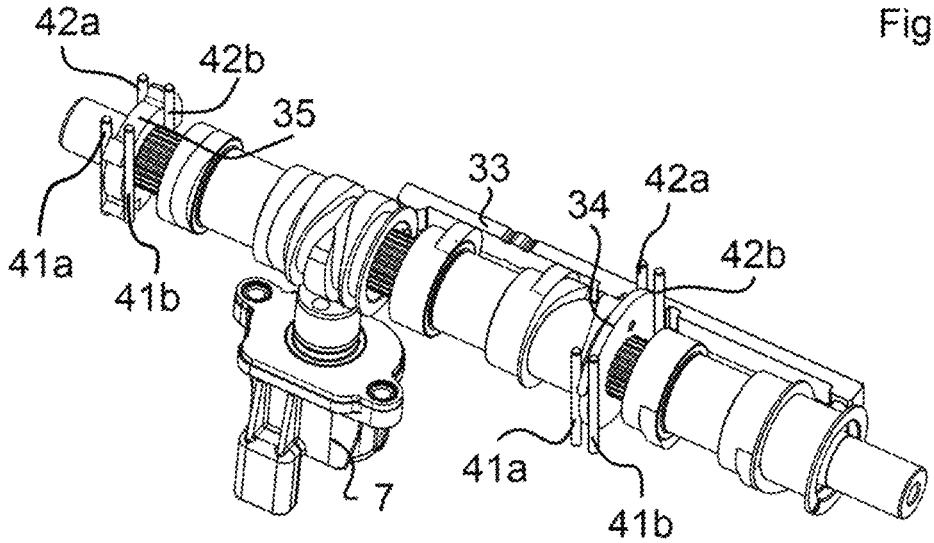
FIG. 6 shows a camshaft of a cylinder head cover according to the invention in a perspective view, with a sensor wheel and a locking disk which are each fixed in the axial direction by an axial bearing which consists of two pin pairs.

FIG. 6 shows one embodiment of the cylinder head cover according to the invention, in the case of which both the locking disk 34 and the sensor wheel 35 are fixed in the axial direction by means of the axial bearing 4 according to the invention. With regard to the further details, reference can be made to the axial bearing 4 of the locking disk 34 or sensor wheel 35 already outlined above. Here, for example, the locking disk 34 is axially "displaceable/loose" on the camshaft 3, and serves to dissipate the displacement forces into the cylinder head cover.

Overstressing or jamming can result if the sensor wheel 35 which is attached axially fixedly on the camshaft 3 is likewise guided by the pins 41/42 and, as a result, the sensor wheel 35 is fixed with respect to the camshaft. Axial mounting of the camshaft 3 is possible. Via the sensor wheel 35 which is fixed on the camshaft, the camshaft can be guided axially in the cylinder head cover.

Figure 6A:
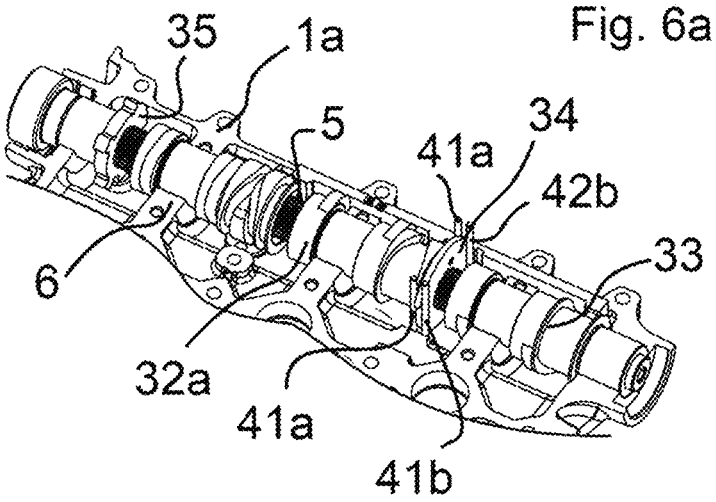
FIG. 6*a* shows a camshaft of a cylinder head cover according to the invention in a perspective view, which cylinder head cover comprises a first cylinder head cover element and a second cylinder head cover element (for illustrative purposes, only the first cylinder head cover element is shown here).
Figure 6B:
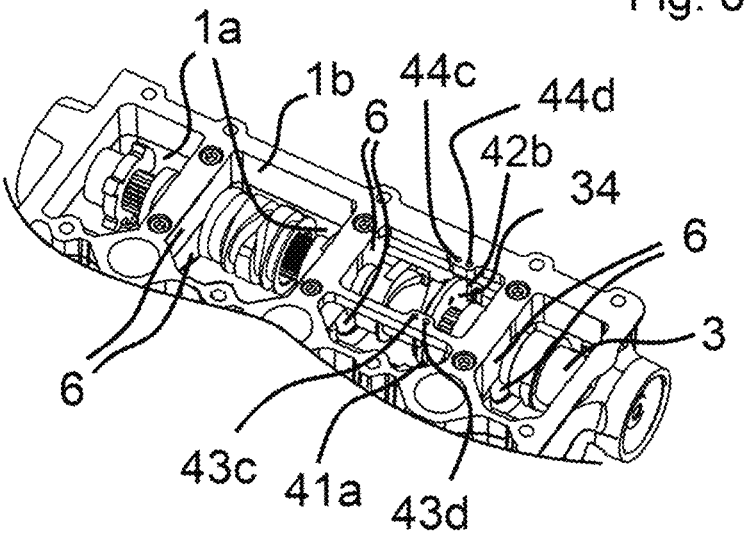
FIG. 6*b* shows a camshaft of a cylinder head cover according to the invention in a perspective view, which cylinder head cover comprises a first cylinder head cover element and a second cylinder head cover element.

As has already been described above, the cylinder head cover comprises a cylinder head cover main body 1 and a bearing frame 2. It can also be provided as an alternative that the cylinder head cover comprises a first cylinder head cover element 1*a* and a second cylinder head cover element 1*b*. It can also be provided here that the cylinder head cover elements can be connected to one another, preferably by means of screw connection. A configuration of this type is shown in FIGS. 6*a* and 6*b*.

It can preferably be provided fundamentally for all embodiments that the pin pairs 41*a*, 41*b* and/or 42*a*, 42*b* are arranged perpendicularly with respect to the rotational axis D of the camshaft 3, the pins of the pin pair or the pins of the pin pairs 41*a*, 41*b* and/or 42*a*, 42*b* are received in receiving openings 43*a*, 43*b*, 43*c*, 43*d* and/or 44*a*, 44*b*, 44*c*, 44*d*, and/or at least one pin of the pin pair, preferably the two pins of the pin pair 41*a*, 41*b* and/or 42*a*, 42*b*, are/is received rotatably in the receiving openings 43*a*, 43*b*, 43*c*, 43*d* and/or 44*a*, 44*b*, 44*c*, 44*d*. The pins 41*a*, 41*b* and/or 42*a*, 42*b* can also be received fixedly in the provided receiving openings 43*a*, 43*b*, 43*c*, 43*d* and/or 44*a*, 44*b*, 44*c*, 44*d*.

The method according to the invention is to be explained in greater detail in the following text on the basis of FIGS. 7 to 10. It goes without saying that only a few selected method steps are shown here, as are helpful for understanding the method according to the invention. The method can comprise further steps or intermediate steps which are known to a person skilled in the art.

Figure 7:
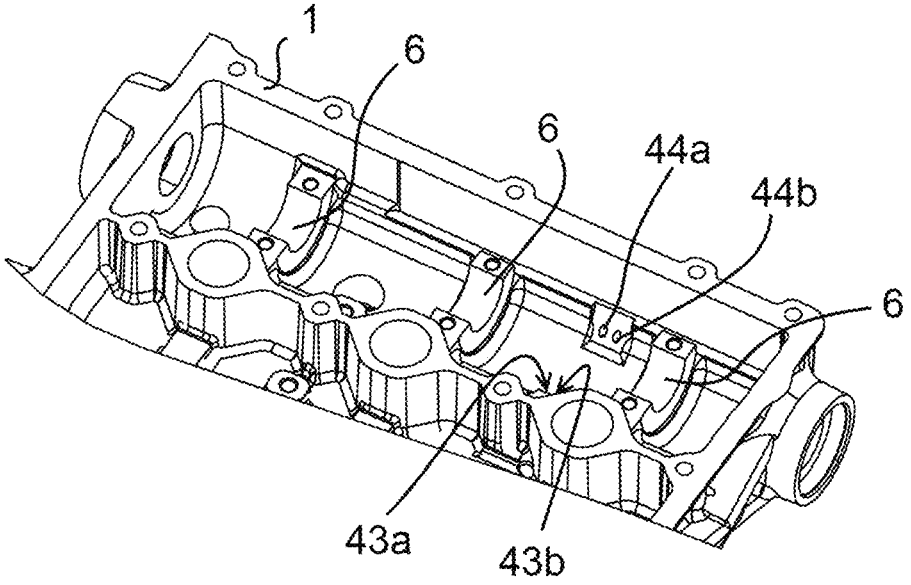
FIGS. 7-10 show a diagrammatic illustration of assembly steps of a cylinder head cover according to the invention.

FIG. 7 shows a cylinder head cover main body 1 for a cylinder head cover according to the invention. The cylinder head cover main body 1 is equipped with receiving openings 43*a*, 43*b* and/or 44*a*, 44*b* for the pins 41*a*, 41*b* and/or 42*a*, 42*b*.

Figure 8:
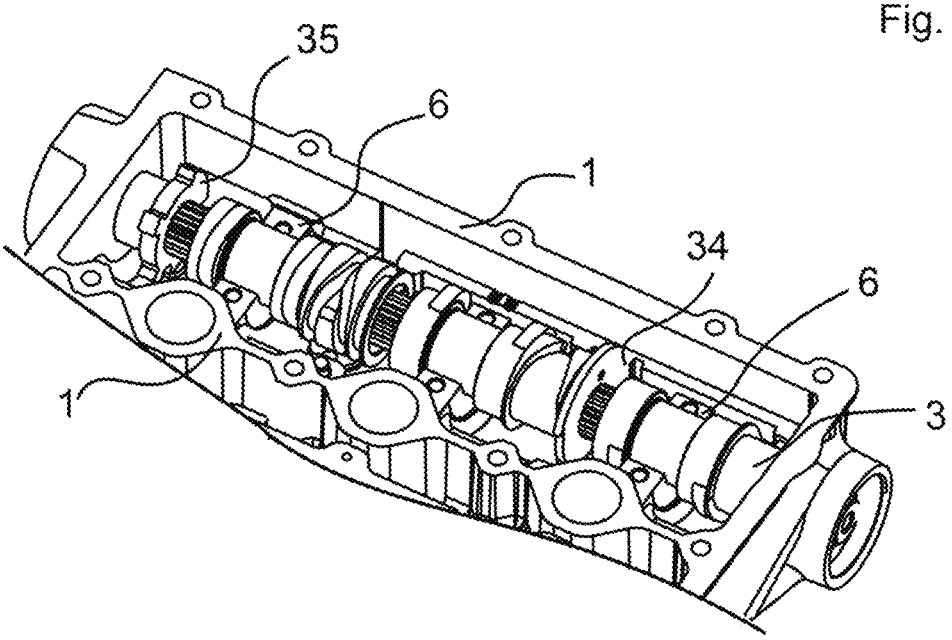

First of all, the camshaft 3 is inserted with the functional components 34, 35 into bearing half shells 6 of the cylinder head cover main body 1 (cf., in particular, FIG. 8).

Figure 9:
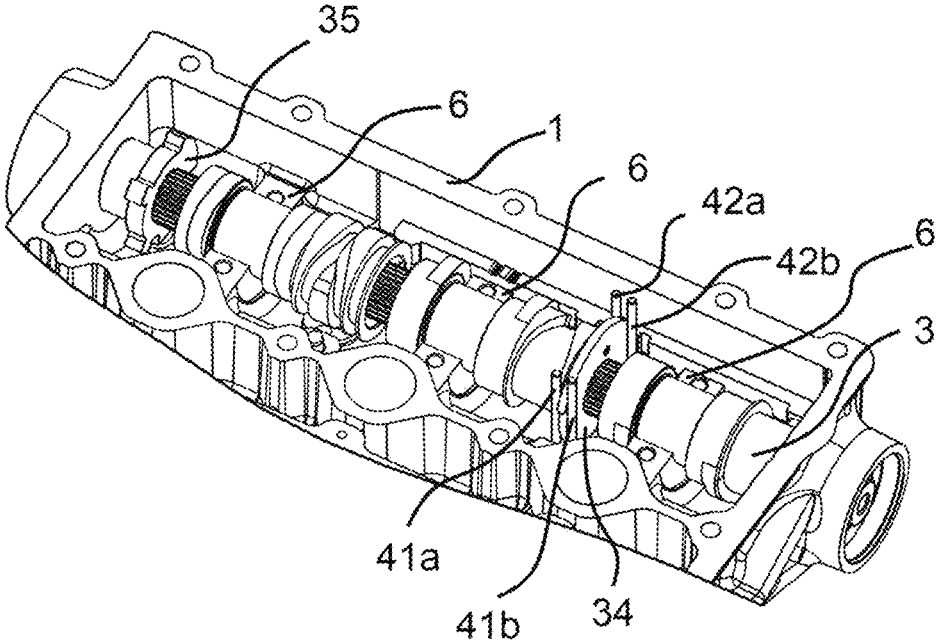

It can be provided in a further method step that the pins of the pin pair or the pin pairs 41*a*, 41*b* and/or 42*a*, 42*b* of the axial bearing 4 are inserted in sections into the receiving openings 43*a*, 43*b*, 44*a*, 44*b* of the cylinder head cover main body 1 (FIG. 9). Accordingly, they protrude out of the receiving openings of the cylinder head cover main body 1. As an alternative, the pins can have already been inserted before the insertion of the camshaft.

Figure 10:
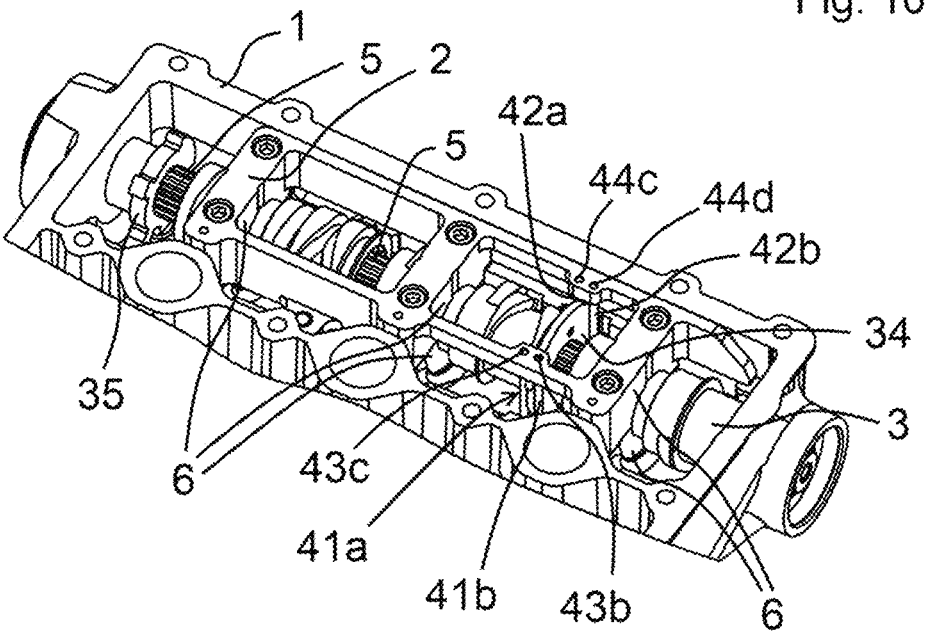

Subsequently, the bearing frame 2 is placed onto the cylinder head cover main body 1. The bearing frame 2 and the cylinder head cover main body 1 complete the bearing seats or pivot bearing seats 6 for the camshaft 3. In addition, the pins 41*a*, 41*b* and/or 42*a*, 42*b* dip in sections into the receiving openings 43*c*, 43*d* and/or 44*c*, 44*d* of the bearing frame 2 and complete the axial bearing 4 (FIG. 10).

As a result, the locking disk 34 is fixed axially. In the embodiment which is depicted here, the functional component, in particular the locking disk 34, is connected to the basic shaft 31 of the camshaft 3 by means of a sliding spline system 5. Torques can correspondingly be transmitted. The basic shaft 31 and the locking disk 34 can fundamentally be displaced with respect to one another, however.

In principle, the pins 41*a*, 41*b* and/or 42*a*, 42*b* can also be previously joined in the bearing frame 2, and can be mounted together with the latter on the cylinder head cover main body 1. The advantage lies, in particular, in that threading of the pins 41*a*, 41*b* and/or 42*a*, 42*b* takes place outside the cylinder head cover main body 1 and the pins can be handled more easily. After placing the bearing frame on top, the pins engage into the receiving openings 43*a*, 43*b* and/or 44*a*, 44*b* for the pins of the cylinder head cover main body 1.

The method steps can finally also be applied to different or additional functional components such as, for example, the sensor disk.

The functional component or the functional components 34, 35 can fundamentally also be connected fixedly to the basic shaft 31, with the result that the basic shaft 31 and/or camshaft 3 is/are finally also indirectly fixed axially in the cylinder head cover by the proposed axial bearing. One functional component is preferably connected fixedly and the other functional components are connected displaceably to the basic shaft, with the result that static overstressing is avoided and/or thermal expansions can be enabled. A configuration of this type is shown in FIG. 6*b*.

Although the method is outlined here for the configuration comprising cylinder head cover main body 1 and bearing frame 2, the method can likewise be applied to the configuration of first cylinder head cover element 1*a* and second cylinder head cover element 1*b*.

The invention claimed is:

1. A cylinder head cover with a camshaft received rotatably in the cylinder head cover, comprising:

an axial bearing including at least one pin pair;

wherein the camshaft is equipped with a functional component fixed axially on the camshaft, or with a functional component received axially displaceably on the camshaft;

wherein the functional component is arranged between pins of the at least one pin pair such that, in a case where the functional component is received fixed axially on the camshaft, the pins of the pin pair provide the axial bearing and fix an axial location of the camshaft, including the functional component, relative to the cylinder head cover, and such that, in a case where the functional component is received axially displaceably on the camshaft, the pins of the pin pair provide the axial bearing and fix an axial location of the functional component relative to the cylinder head cover.

2. The cylinder head cover as claimed in claim 1, wherein the pin pair comprises a first pin and a second pin.

3. The cylinder head cover as claimed in claim 1, wherein the axial bearing comprises a further pin pair, between which the functional component is arranged.

4. The cylinder head cover as claimed in claim 1, wherein the pin pair is arranged perpendicularly with respect to the rotational axis of the camshaft.

5. The cylinder head cover as claimed in claim 1, wherein the pins of the pin pair are received in sections in receiving openings.

6. The cylinder head cover as claimed in claim 5, wherein at least one pin of the pin pair is received rotatably in the receiving openings.

7. The cylinder head cover as claimed in claim 5, wherein two pins of the pin pair are received rotatably in the receiving openings.

8. The cylinder head cover as claimed in claim 1, wherein the functional component is a locking disk, a sensor wheel, or a cam.

9. The cylinder head cover as claimed in claim 1, wherein the functional component is a locking disk, a sensor wheel, or a pump lobe.

10. The cylinder head cover as claimed in claim 1, wherein the camshaft is a sliding camshaft, comprising a basic shaft and at least one sliding cam.

11. The cylinder head cover as claimed in claim 1, wherein the camshaft is a sliding camshaft, comprising a basic shaft and at least one sliding cam, wherein the sliding camshaft comprises two sliding cams which are connected to one another by a coupling rod.

12. The cylinder head cover as claimed in claim 1, wherein the functional component is selectively attached fixedly or axially displaceably on the camshaft.

13. The cylinder head cover as claimed in claim 1, wherein the cylinder head cover comprises a first cylinder head cover element and a second cylinder head cover element, wherein receiving openings for the pins are provided both in the first cylinder head cover element and in the second cylinder head cover element.

14. A method for assembling a cylinder head cover as claimed in claim 13, comprising:

inserting the camshaft with the functional component into bearing half shells of the cylinder head cover;

introducing the pins into the receiving openings of the first cylinder head cover element, such that the pins engage the functional component; and placing the second cylinder head cover element onto the first cylinder head cover element, wherein the pins dip in portions into the receiving openings of the second cylinder head cover element.

15. The cylinder head cover as claimed in claim 1, wherein the cylinder head cover comprises a cylinder head cover main body and a bearing frame, wherein receiving openings for the pins are provided both in the cylinder head cover main body and in the bearing frame.

16. A method for assembling a cylinder head cover as claimed in claim 15, comprising:

inserting the camshaft with the functional component into bearing half shells of the cylinder head cover main body;

introducing the pins into the receiving openings of the cylinder head cover main body, such that the pins engage the functional component; and placing the bearing frame onto the cylinder head cover main body, wherein the pins dip in portions into the receiving openings of the bearing frame.

* * * * *